US006554274B2

(12) United States Patent
Middelberg et al.

(10) Patent No.: US 6,554,274 B2
(45) Date of Patent: Apr. 29, 2003

(54) RIGHT ANGLE STAGER APPARATUS AND METHOD

(75) Inventors: Neal J. Middelberg, Apex, NC (US); James M. Guberski, Holly Springs, NC (US); Gerard A. DeRome, Jr., Cary, NC (US); Vincenzo Tucci, Raleigh, NC (US); Robert B. Bennett, Raleigh, NC (US)

(73) Assignee: Bell & Howell Mail and Messaging Technologies Company, Durham, NC (US)

( * ) Notice: Subject to any disclaimer, the term of this patent is extended or adjusted under 35 U.S.C. 154(b) by 0 days.

(21) Appl. No.: 09/947,138

(22) Filed: Sep. 5, 2001

(65) Prior Publication Data

US 2002/0030320 A1 Mar. 14, 2002

Related U.S. Application Data

(62) Division of application No. 09/568,876, filed on May 9, 2000, now Pat. No. 5,205,551.

(60) Provisional application No. 60/167,052, filed on Nov. 22, 1999, and provisional application No. 60/166,434, filed on Nov. 19, 1999.

(51) Int. Cl.[7] ..... B65H 5/00

(52) U.S. Cl. ..... 271/225; 271/184; 271/9.13; 271/9.12

(58) Field of Search ..... 271/3.14, 3.17, 271/9.01, 9.12, 9.13, 184, 225

(56) References Cited

U.S. PATENT DOCUMENTS

| | | | | | |
|---|---|---|---|---|---|
| 2,617,647 | A | * | 11/1952 | Davis | 270/59 |
| 4,273,319 | A | * | 6/1981 | Stocker | 270/21.1 |
| 4,795,143 | A | | 1/1989 | Tsai | |
| 4,909,374 | A | * | 3/1990 | Skrypalle | 198/371.3 |
| 5,083,769 | A | | 1/1992 | Young, Jr. | |
| 5,180,154 | A | | 1/1993 | Malick | |
| 5,188,355 | A | * | 2/1993 | Lowell et al. | 271/225 |
| 5,205,551 | A | * | 4/1993 | Nagano et al. | 271/225 |
| 5,318,285 | A | | 6/1994 | Edwards et al. | |
| 5,362,039 | A | | 11/1994 | Kusters | |
| 5,413,326 | A | * | 5/1995 | Wright | 271/225 |
| 5,439,208 | A | * | 8/1995 | Moser et al. | 271/225 |
| 5,575,465 | A | * | 11/1996 | Auerbach et al. | 271/9.13 |
| 5,833,232 | A | | 11/1998 | Ifkovits et al. | |
| 5,882,175 | A | | 3/1999 | Fernandez | |
| 5,934,670 | A | | 8/1999 | Todoki | |
| 5,957,652 | A | | 9/1999 | Mimura et al. | |
| 6,044,958 | A | | 4/2000 | Emery | |
| 6,089,558 | A | | 7/2000 | Okumura | |
| 6,092,802 | A | | 7/2000 | Lackner et al. | |
| 6,341,773 | B1 | * | 1/2002 | Aprato et al. | 271/9.13 |
| 6,378,861 | B1 | * | 4/2002 | Middelberg et al. | 271/225 |
| 6,402,136 | B1 | * | 6/2002 | Lamothe | 271/185 |
| 6,443,447 | B1 | * | 9/2002 | Ifkovits et al. | 271/225 |

* cited by examiner

*Primary Examiner*—Patrick H. Mackey
(74) *Attorney, Agent, or Firm*—McDermott, Will & Emery

(57) ABSTRACT

A right-angle sheet stager apparatus for merging multiple input sheet streams into a single output sheet stream includes one or more input channels and an output channel. Each input channel includes a transport surface and a staging surface. Each transport surface communicates with its corresponding staging surface at a transitional member interposed between the transport surface and the staging surface. Each transitional member includes an upper surface disposed at an elevation greater than an elevation of the corresponding staging surface. The output channel includes an output surface, and is oriented in a right-angle relation with respect to the input channels and communicates with the input channels at a merger location. The stager apparatus permits a sheet from the transport surface to enter the staging surface and overlap with a preceding sheet already present on that staging surface, prior to the preceding sheet's complete exit from the staging surface.

25 Claims, 9 Drawing Sheets

RIGHT ANGLE STAGER APPARATUS AND METHOD

CROSS-REFERENCE TO RELATED APPLICATIONS

This application is a divisional of co-pending U.S. patent application Ser. No. 09/568,876 filed May 9, 2000, now U.S. Pat. No. 5,205,551 the contents of which are incorporated herein by reference, which claims priority to U.S. Provisional Application Serial No. 60/166,434 filed Nov. 19, 1999 and further claims priority to U.S. Provisional Application Serial No. 60/167,052 filed Nov. 22, 1999.

TECHNICAL FIELD

The present invention is directed to the handling of one or more streams of documents and, more particularly, is directed to the high-throughput staging of documents and right-angle turning of document streams.

BACKGROUND ART

Staging devices are utilized in a wide variety of document handling and mail processing operations. Such operations can involve a number of different modules or stations that perform specific tasks, such as accumulating, folding, printing, shearing, merging, envelope stuffing, and combinations thereof. These operations often require that sheets be physically turned 90 degrees at some point on the sheet path, yet still demand that a commercially acceptable level of throughput be maintained. Examples of systems in which sheets must be physically turned in order to effect a change in conveying direction are disclosed in U.S. Pat. Nos. 5,362,039 and 5,439,208.

In some of these operations, two or more sheet streams must be merged into a single stream. One example is the processing of two-up material, which can typically be provided on a 17 inch continuous roll. The width of the roll is such that two 8.5×11 inch printed pages are disposed in adjacent relation to each other. Several side-by-side pairs of such pages are contained in succession along the length of the roll.

A staging module is typically used whenever an application requires that one or more sheets in one or more process streams be paused or held for a certain period of time while other operations are performed, initialized, or reset. In operations such as those briefly described above, the use of a staging module can be useful for assisting in the synchronization of the various operations being conducted on the sheets. Unfortunately, a conventional staging module can slow down throughput to an unacceptable level. This is because a sheet residing in a conventional staging module must completely exit the staging area before the next sheet in the sheet stream can enter therein. As a result, some document handling systems that could benefit from the use of a staging module avoid such use altogether. Throughput is further slowed in conventional operations that require sheets to be physically rotated at some point along the process path.

It would therefore be advantageous to provide a sheet stager apparatus that is capable of permitting a high level of throughput and is consequently useful in a wide variety of document handling and mail processing operations without impeding such operations. It would be further advantageous to provide a high-throughput stager apparatus that has the additional ability of turning the sheet path 90 degrees without requiring sheets to be physically turned, thereby eliminating the need for a separate conventional sheet turning module.

DISCLOSURE OF THE INVENTION

The present invention provides a right-angle sheet stager apparatus for merging multiple input sheet streams into a single output sheet stream. In one embodiment according to the present invention, the stager apparatus comprises a plurality of input channels. Each input channel includes a transport surface and a staging surface. Each staging surface is disposed downstream of its corresponding transport surface. One of the staging surfaces is disposed at an elevation different from an elevation of one of the other staging surfaces. An output channel includes an output surface. The output channel is oriented in a right-angle relation with respect to the input channels and communicates with the input channels at a merger location.

In another embodiment according to the present invention, a right-angle sheet stager apparatus comprises a plurality of input channels. Each input channel includes a transport surface, a staging surface, and a transitional member interposed between the transport surface and the staging surface. Each staging surface is disposed downstream of its corresponding transport surface. One of the transitional members includes an upper surface disposed at an elevation greater than an elevation of its corresponding staging surface. An output channel includes an output surface. The output channel is oriented in a right-angle relation with respect to the input channels and communicates with the input channels at a merger location.

In yet another embodiment according to the present invention, a right-angle sheet stager apparatus comprises an inside input path including an inside transport surface and an inside staging surface. The inside staging surface has an elevation and communicates with the inside transport surface at an inside interface location. The inside interface location includes an upper surface having an elevation greater than the elevation of the inside staging surface. An outside input path includes an outside transport surface and an outside staging surface communicating with the outside transport surface at an outside interface location. The outside staging surface has an elevation different from the elevation of the inside staging surface. The outside interface location includes an upper surface having an elevation greater than the elevation of the outside staging surface. An output path includes an output surface. The output path is oriented in a right-angle relation with respect to the inside and outside input paths, and communicates with the inside and outside input paths at a merger location.

In a further embodiment according to the present invention, a document handling apparatus comprises an input path structure, an output path structure, and a staging and document turning assembly. The input path structure includes an input surface and a first document moving device disposed in operative engagement with the input surface. The output path structure is oriented perpendicularly with respect to the input path structure and includes an output surface. The staging and document turning assembly is interposed between the input path structure and the output path structure and includes a staging surface and a second document moving device. The staging surface defines an interface between the input surface and the output surface. The second document moving device is disposed in operative engagement with the staging surface and is oriented perpendicularly with respect to the first document moving device.

The present invention also provides a method for merging multiple input sheet streams into a single output sheet stream oriented at a right angle with respect to the input sheet streams. The method comprises the following steps. A staging area is provided and includes a plurality of staging surfaces disposed at different elevations. A plurality of sheets are fed in a plurality of input sheet streams into the staging area, wherein each input sheet stream communicates with a corresponding one of the staging surfaces. A sheet outfeed area is provided and includes an output surface in communication with each of the staging surfaces. A first sheet is staged on a first one of the staging surfaces. The first sheet is brought into contact with a sheet driving mechanism. The sheet driving mechanism is activated to transport the first sheet towards the outfeed area. A second sheet is permitted to enter the first staging surface and to overlap with the first sheet prior to transportation of the entire first sheet out of the staging area. The method can further comprise the step of permitting a plurality of sheets to enter the first staging surface and accumulate thereon prior to transportation of the first sheet out of the staging area.

In another method for merging multiple input sheet streams into a single output sheet stream oriented at a right angle with respect to the input sheet streams, a staging area includes a plurality of staging surfaces disposed at different elevations and each staging surface includes a sheet driving element operatively associated therewith. A plurality of sheets are fed in a plurality of input sheet streams into the staging area. Each input sheet stream communicates with a corresponding one of the staging surfaces. A sheet outfeed area is provided, and includes an output surface in communication with each of the staging surfaces. A first sheet is staged on a first one of the staging surfaces, and a second sheet is staged on a second one of the staging surfaces. The first sheet is brought into contact with the sheet driving element of the first staging surface, and the second sheet is brought into contact with the sheet driving element of the second staging surface. The sheet driving element of the first staging surface is activated to transport the first sheet towards the outfeed area in a direction substantially perpendicular to at least one of the input sheet streams. The sheet driving element of the second staging surface is also activated to transport the second sheet towards the outfeed area in a direction substantially perpendicular to at least one of the input sheet streams. The first and second sheets are then merged into a single output stream substantially perpendicular to at least one of the input sheet streams.

The method can further comprise the step of causing a subsequent sheet to enter the first staging surface and to overlap with the first sheet prior to transportation of the first sheet out of the staging surface. The method can also comprise the step of permitting a plurality of sheets to enter the first staging surface and accumulate thereon prior to transportation of the first sheet out of the staging area.

The method can still further comprise the step of causing sheets from one or more of the input sheet streams to overlap at merger location.

Accordingly, it is an object of the present invention to provide a right-angle sheet stager apparatus that is capable of achieving higher levels of throughput than conventional staging devices.

It is another object of the present invention to provide a sheet stager apparatus in which sheets are permitted to overlap in the staging area and thereby increase throughput.

It is a further object of the present invention to provide a sheet stager apparatus in which tight control over the flow of the sheet streams is maintained even at the higher level of throughput achieved by the stager apparatus.

It is yet another object of the present invention to provide a high-throughput stager apparatus which also functions to turn the direction of the sheet stream path 90 degrees without causing the individual sheets to be physically rotated.

Some of the objects of the invention having been stated hereinabove, and which are achieved in whole or in part by the present invention, other objects will become evident as the description proceeds when taken in connection with the accompanying drawings as best described hereinbelow.

DETAILED DESCRIPTION OF THE INVENTION

Figure 1:
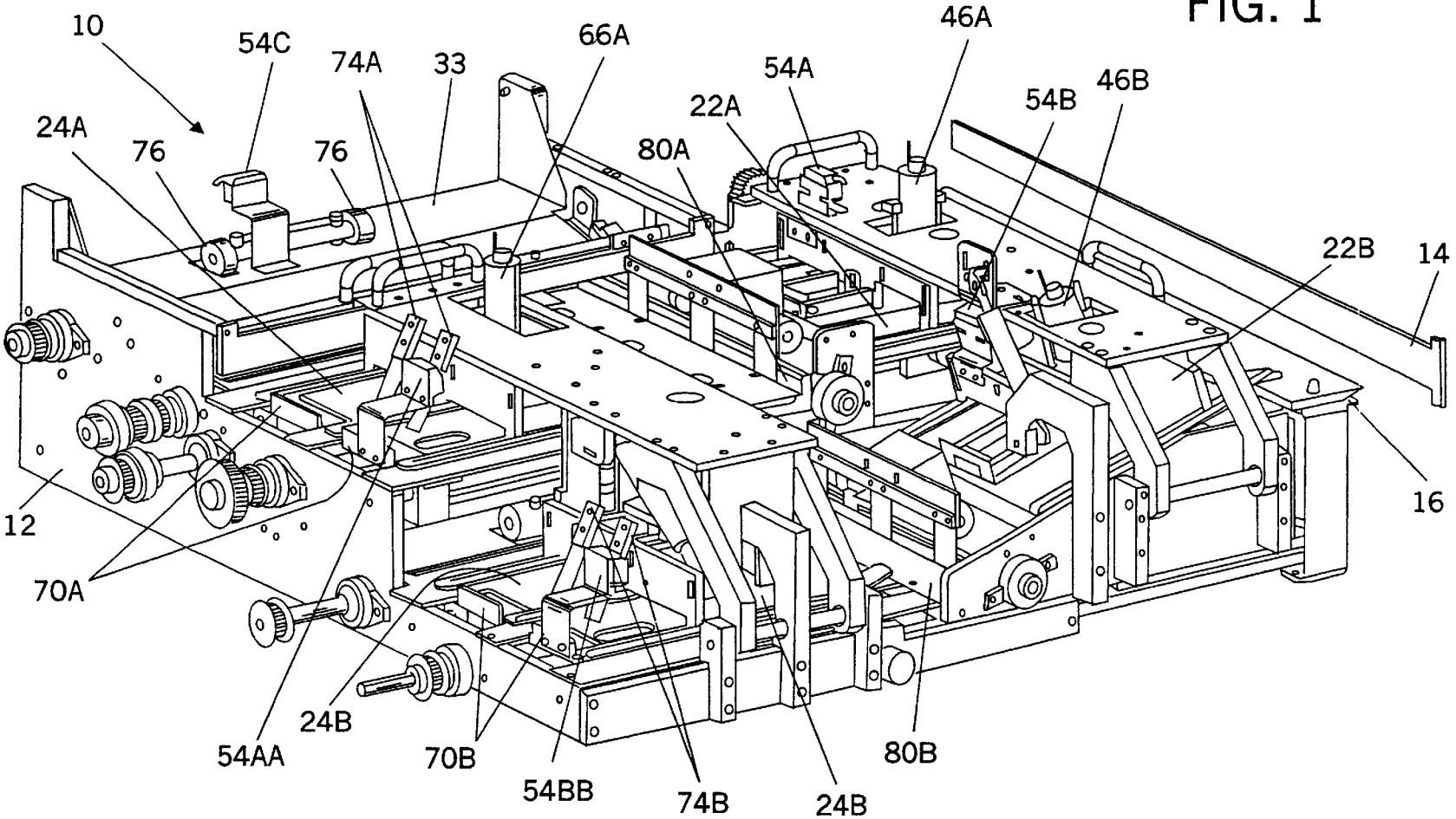
FIG. 1 is a perspective view of a right-angle stager apparatus according to the present invention.
Figure 2:
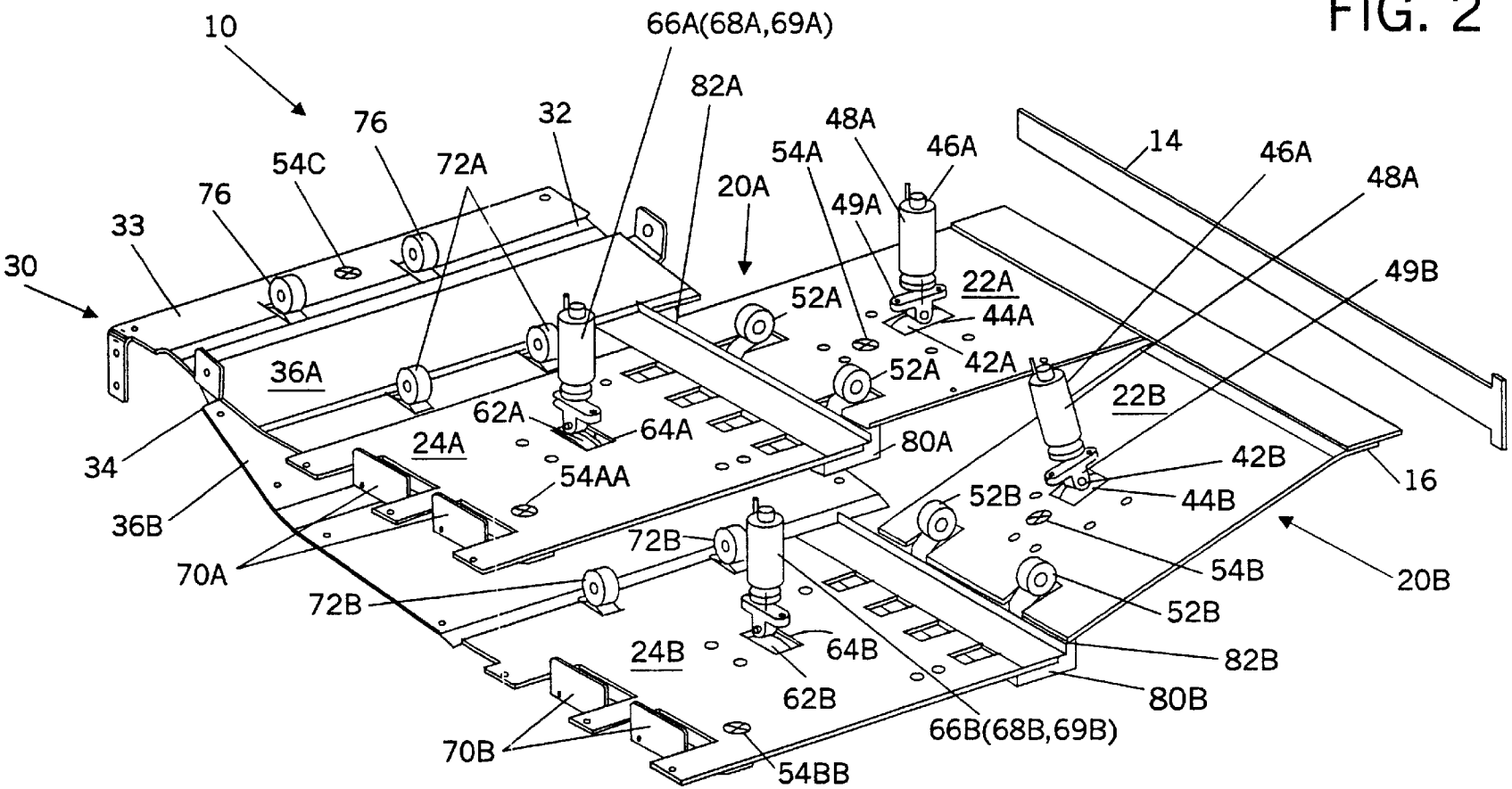
FIG. 2 is a perspective view of the stager apparatus of FIG. 1 with the main structural framework removed.
Figure 3:
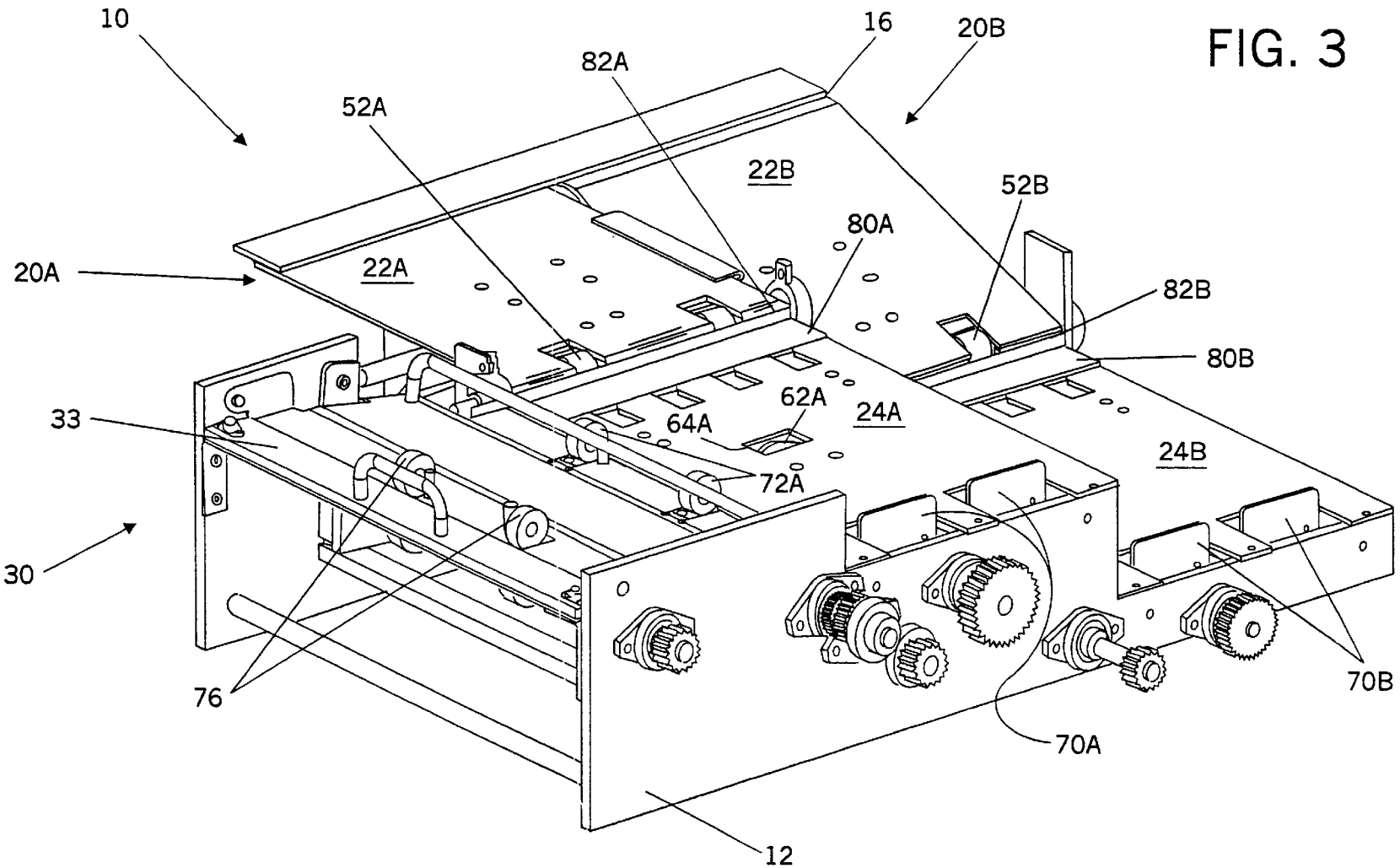
FIG. 3 is another perspective view of the stager apparatus of FIG. 1, with portions of the main structural framework and some of the sheet-driving components removed.

Referring in particular to FIGS. 1, 2 and 3, a right angle stager apparatus according to the present invention is generally designated 10. Many of the operative components pertinent to the present invention are mounted within a main structural framework 12 of stager apparatus 10. Stager apparatus 10 includes one or more input channels situated downstream of a cutting mechanism 14 or some other appropriate input feed device. Beginning at a threshold surface 16, the input channels define separate input paths for cut sheets. In the exemplary embodiment shown in FIGS. 1–4, stager apparatus 10 is adapted to process two-up sheets and accordingly includes two input channels: an inside channel generally designated 20A (as shown only in FIGS. 2 and 3) and an outside channel generally designated 20B (as shown only in FIGS. 2 and 3). Each input channel 20A,20B includes a transport surface and a staging surface. Accordingly, inside channel 20A includes an inside transport surface 22A and an inside staging surface 24A. Likewise, outside channel 20B includes an outside transport surface 22B and an outside staging surface 24B. The input paths terminate at a staging area defined in part by inside staging surface 24A and outside staging surface 24B.

An output channel generally designated 30 (shown in FIGS. 2 and 3) provides an output path oriented at a right angle to the input paths. Output channel 30 includes an output surface 32 disposed beneath an upper guide plate 33 and a merger location 34 (as best shown in FIG. 3) at which the separate streams of sheets exiting from the staging area merge into a single output stream. Output channel 30 further includes a post-staging surface interposed between each respective staging surface 24A,24B and merger location 34. Thus, in the exemplary two-up design presently being described, an inside post-staging surface 36A and an outside post-staging surface 36B are employed. One or more of post-staging surfaces 36A,36B can be inclined in order to effect a smooth transition from differently elevated staging surfaces 24A,24B to output surface 32.

Figure 5:
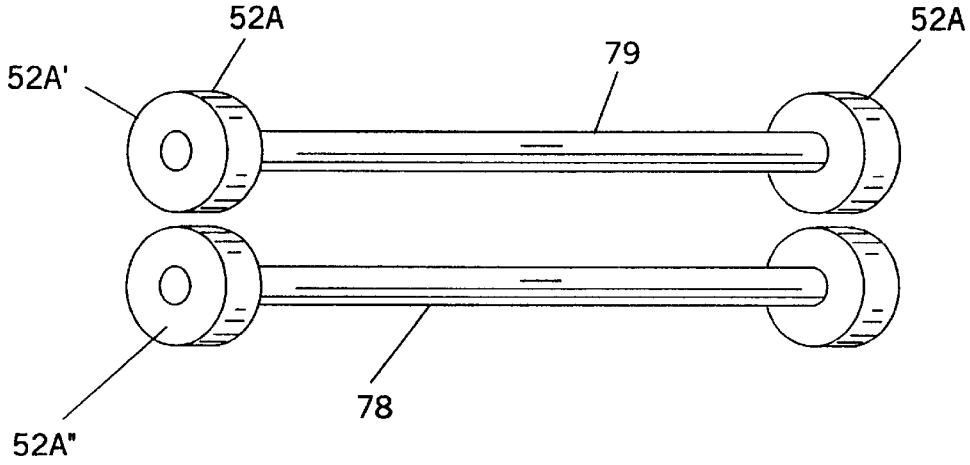
FIG. 5 is a perspective view of a configuration of nip rollers utilized in the present invention.

Referring specifically to FIG. 2, each transport surface 22A,22B includes mechanisms for driving sheets forwardly along their respective input paths. In the preferred embodiment, a constantly rotating drive roller 42A is disposed below inside transport surface 22A proximate to a hole or slot 44A on inside transport surface 22A. A vertically reciprocative actuator 46A is disposed directly above drive roller 42A, and includes a solenoid 48A and roller bearing 49A. One or more pairs of input nip rollers 52A are disposed at the downstream end of inside transport surface 22A. As shown in FIG. 5, each pair of input nip rollers 52A includes an upper roller 52A' disposed generally above inside transport surface 22A and a lower roller 52A" disposed generally below inside transport surface 22A. In addition, an optical sensor 54A, preferably of the photocell type, is provided. Optical sensor 54A is disposed either above inside transport surface 22A as shown in FIG. 1 or on inside transport surface 22A as shown in FIG. 2. Reed switches or other types of sensors could be substituted for optical sensor 54A, as is understood by those skilled in the art.

Inside staging surface 24A can include sheet driving mechanisms similar to those of inside transport surface 22A. Thus, in the preferred embodiment shown in FIGS. 1 and 2, inside staging surface 24A includes a drive roller 62A disposed below a hole or slot 64A of inside staging surface 24A; an actuator 66A with a solenoid 68A and roller bearing 69A disposed above drive roller 62A; one or more pairs of take-away nip rollers 72A; and an optical sensor 54AA or other type of sensor. Take-away nip rollers 72A have a configuration analogous to that of input nip rollers 52A shown in FIG. 5. Drive roller 62A, actuator 66A, and take-away nip rollers 72A are disposed at a right angle with respect to the sheet driving mechanisms of inside transport surface 22A. In addition, inside staging surface 24A includes stop members 70A defining the terminus of the inside input path.

One or more vertically disposed sheet guides 74A are disposed above inside staging surface 24A, as shown in FIG. 1. Preferably, the operative component of each sheet guide 74A is a highly flexible, polymeric strip. Sheet guides 74A constructed of polymeric material are elastic enough to yield in the direction of sheet flow and recover to the original, vertical position after a sheet has passed, yet have enough stiffness to perform the sheet guiding function. Such sheet guides 74A are therefore believed to be superior to conventional metallic guides, which are prone to plastic (i.e., inelastic and non-recoverable) deformation and frequent replacement.

Outside channel 20B preferably includes transport components analogous to those used in the design of inside channel 20A. Accordingly, outside transport surface 22B includes a drive roller 42B disposed below outside transport surface 22B proximate to a hole or slot 44B on outside transport surface 22B; a vertically reciprocative actuator 46B, including a solenoid 48B and roller bearing 49B, disposed directly above drive roller 42B; one or more pairs of input nip rollers 52B disposed at the downstream end of outside transport surface 22B; and an optical sensor 54B or other type of sensor. In addition, outside staging surface 24B includes a drive roller 62B disposed below a hole or slot 64B of outside staging surface 24B; an actuator 66B, including a solenoid 68B and roller bearing 69B, disposed above drive roller 62B, one or more pairs of take-away nip rollers 72B; an optical sensor 54BB or other type of sensor; stop members 70B defining the terminus of the outside input path; and vertically disposed, polymeric sheet guides 74B disposed above outside staging surface 24B (see FIG. 1). Input nip rollers 52B and take-away nip rollers 72B have a configuration similar to that of input nip rollers 52A shown in FIG. 5.

Output channel 30 includes one or more pairs of exit nip rollers 76 which can be of the same general design as input nip rollers 52A,52B and take-away nip rollers 72A,72B. Output channel 30 likewise includes an optical sensor 54C or other type of sensor. Output channel 30 can have either a left or right hand orientation with respect to input channels 20A and 20B. In addition, a second output channel (not shown) can be provided on the side of the staging area opposite to that of output channel 30. In this manner, one or more of the sheet streams entering the staging area could be caused to turn either left or right upon the appropriate programming of stager apparatus 10.

The operative driving components of stager apparatus 10, including drive rollers 42A,42B,62A,62B and nip rollers 52A,52B,72A,72B,76 can be powered by means of conventional transmission and motor devices (not specifically referenced herein). In addition, it is preferable that stager apparatus 10 operate under the control of a computer or other electronic control and monitoring device (not shown). Accordingly, drive rollers 42A,42B,62A,62B, actuators 46A,46B,66A,66B and optical sensors 54A,54AA,54B, 54BB,54C should all be wired to the electronic device to enable transmission of electronic control and monitoring signals or other data. Optionally, nip rollers 52A,52B,72A, 72B,76 can also be wired for communication with the electronic control device for monitoring purposes.

Figure 4:
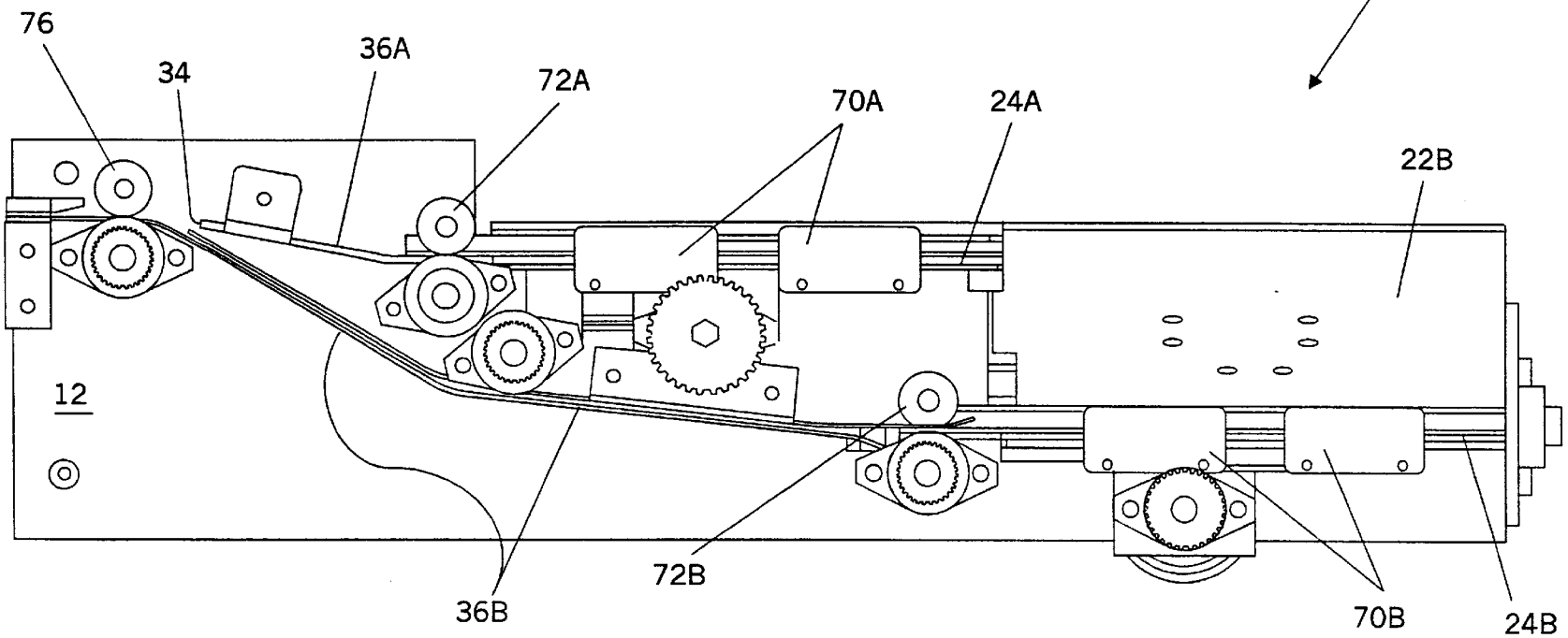
FIG. 4 is a front elevation view of the stager apparatus of FIG. 1 with the main structural framework partially cut away to show the staging surfaces.

Referring to FIGS. 2 and 4, in order to improve control over the sheets traveling through the various paths of stager apparatus 10, it is preferable that each of nip rollers 62A, 52B,72A,72B,76 be provided as a roller set consisting of two pairs of opposing rollers, and each roller set be employed for each respective surface 22A,22B,24A,24B,32. Moreover, as illustrated in the representative case of input nip rollers 52A in FIG. 5, each of the two pairs of nip rollers 52A,52B,72A,72B,76 is preferably connected at their respective lower rollers by a common axle. Thus, in FIG. 5, lower rollers 52A" are connected through a lower axle 78. In this manner, each of the two pairs of nip rollers 52A,52B, 72A,72B,76 rotate at the same speed, thereby imparting equal force to sheets through two points of contact to prevent sheets from twisting or deviating from their proper paths. Finally, FIG. 4 also shows that upper rollers 52A' can optionally be connected through an upper axle 79. As an alternative, upper axle 79 could serve as the fixed, common axle on which upper rollers 52A' are forced to rotate at the same speed.

In order to achieve the high speed at which stager apparatus 10 operates, it is also preferable that many of the surfaces on which the sheets travel be disposed at different elevations with respect to each other. Hence, outside transport surface 22B can be inclined with respect to inside transport surface 22A, such that the average or effective elevation of outside transport surface 22B is different than the elevation of inside transport surface 22A. In the embodiment shown in FIGS. 1–4, outside transport surface 22B is inclined downwardly and hence effectively lower than inside transport surface 22A. Additionally, outside staging surface 24B is disposed at a lower elevation than that of inside staging surface 24A, such that sheets traveling in different paths are staged at different elevations. In the two-up design exemplified herein and as best shown in FIG. 4, this configuration is preferably implemented by transporting the sheets staged on outside staging surface 24B across extended-length outside post-staging surface 36B. In this configuration, outside post-staging surface 36B extends underneath inside staging surface 24A and inside post-staging surface 36A.

In addition to utilizing differently elevated input paths, the corresponding transport surfaces 22A,22B and staging surfaces 24A,24B in each input path can be differently elevated. This is implemented through the use of inside and outside transitional members 80A and 80B situated at the respective interfaces of corresponding transport surfaces 22A,22B and staging surfaces 24A,24B. In the preferred embodiment, each transitional member 80A,80B has an elongate edge 82A,82B over which sheets travel. Each elongate edge 82A,82B is disposed at a higher elevation than its corresponding staging surface 24A,24B, such that sheets exiting from transport surfaces 22A,22B pass over transitional members 80A,80B and enter respective staging surfaces 24A,24B at a lower elevation. In the embodiment shown in FIG. 2, the downstream end of each transport surface 22A,22B is substantially flush with elongate edge 82A,82B of transitional member 80A,80B, and thus transport surface 22A,22B is disposed at a higher elevation than that of associated staging surface 24A,24B.

Figure 6:
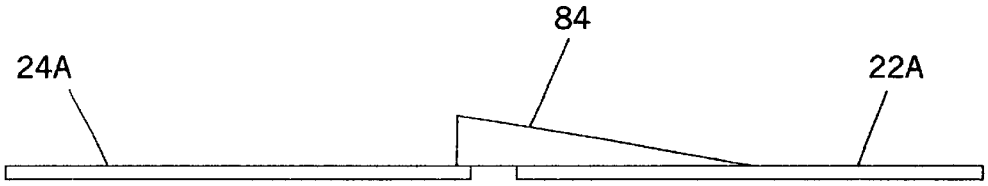
FIG. 6 is a side elevation view of a transitional member according to an alternative embodiment of the present invention.

In an alternative embodiment shown in FIG. 6, inside transport surface 22A could be disposed at the same elevation as inside staging surface 24A (or could even be disposed at a lower elevation with respect to inside staging surface 24A), in which case inside transitional member 80A could include a ramp 84 in order to provide a smooth transition from inside transport surface 22A to inside staging surface 24A. Ramp 84 ensures that each sheet exiting inside transitional member 80A is at a higher elevation than inside staging surface 24A. Similarly, outside transitional member 80B could be equipped with ramp 84 in the manner shown in FIG. 6.

The operation of stager apparatus 10 will now be described with particular reference to FIG. 2. For clarity, it will be assumed that a roll or contiguous stack of two-up sheet material is to be processed. Accordingly, a two-channel apparatus can be employed, such as stager apparatus 10 in the exemplary configuration described above. It will be understood that the individual sheets cut and formed from the two-up material can constitute printed or graphic pages, and that stager apparatus 10 can handle both portrait and landscape configurations. It will be further understood that at some point upstream of stager apparatus 10, the two-up material is cut longitudinally to separate it into two separate sheet streams, and is also cut transversely such as by cutting mechanism 14.

The two sheet streams are advanced to input channels 20A and 20B from an upstream location. As the sheet streams pass onto transport surfaces 22A and 22B to an appropriate distance, optical sensors 54A and 54B will be triggered. If an input feed device such as cutting mechanism is to be employed, the triggering of optical sensors 54A and 54B causes the sheet streams to pause, and cutting mechanism 14 is activated to shear the sheet streams and thereby define the respective trailing edges of individual, side-by-side sheets. Based on the input from optical sensors 54A and 54B, the electronic control system will send signals to activate actuators 46A and 46B, displacing solenoids 48A and 48B downwardly. Roller bearings 49A and 49B force sheets into contact with drive rollers 42A and 42B which causes the sheets to advance to input nip rollers 52A and 52B. Input nip rollers 52A and 52B drive the sheets over transitional members 80A and 80B and into the staging area. As the sheets pass onto their respective staging surfaces 24A and 24B, which are disposed along different elevational positions, the sheets will trigger optical sensors 54AA and 54BB. Stop members 70A and 70B prevent further forward movement of the sheets.

The sheets present on staging surfaces 24A and 24B can be held in the staging area for as long a period of time as required by the particular job being performed and by the downstream operations required. Such downstream operations can include accumulating, printing, scanning, folding, envelope inserting and sealing, or any other suitable processing step as can be appreciated by these of skill in the art. Because all of the optical sensors and many of the driving mechanisms are controlled by the electronic controller, the interface between staging apparatus 10 and the various upstream and downstream modules can be synchronized and programmed according to the needs of the user.

At the desired time, one or both of the sheets on staging surfaces 24A and 24B are advanced at a right angle with respect to input channels 20A and 20B toward post-staging surfaces 36A and 36B and eventually output surface 32 of output channel 30. This is accomplished by activating one or both actuators 66A,66B of staging surfaces 24A,24B in a manner analogous to that of actuators 46A and 46B of transport surfaces 22A and 22B, and also through the operation of take-away nip rollers 72A and 72B. As the sheets exit staging surfaces 24A and 24B, sheets from staging surface 241B pass beneath staging surface 24A, and the sheets from the two staging surfaces converge into a single output stream at merger location 34 and pass over output surface 32 to downstream processes with the assistance of exit nip rollers 76. As each sheet passes over output surface 32, optical sensor 54C detects its presence and can be used to modify the activation timing of the various driving mechanisms of stager apparatus 10, as well as the timing of upstream and downstream modules.

In conventional staging devices, each sheet must completely exit its staging surface prior to the introduction of a subsequent sheet onto that staging surface. When constructed in accordance with the present invention, however, stager apparatus 10 permits overlapping of sheets at staging surfaces 24A and 24B (i.e., stage overlapping) and/or merger location 34 (i.e., exit overlapping). As a result, a significantly higher throughput is achieved.

Overlapping is accomplished through the use of differently elevated surfaces, and also preferably through the use of the nip rollers configured as described above and illustrated in FIG. 5. Hence, as a first sheet on staging surface 24A or 24B starts to exit therefrom, a subsequent second sheet can start to exit transport surface 22A or 22B, pass over higher elevated transitional member 80A or 80B and enter into an overlapping relation with the first sheet. Such overlapping does not impair the operation of stager apparatus 10, and the sheet streams flow from inside channels 20A and 20B to outside channel 30 in a rapid, yet controlled, manner. Moreover, the use of differently elevated staging surfaces 24A and 24B permits a sheet from one staging surface 24A or 24B to overlap with a sheet from another staging surface 24B or 24A at the merger location 34 without impairing the operation of stager apparatus 10.

The desired percentage of overlap among sheets permitted by stager apparatus 10 can be programmed. Moreover, stager apparatus 10 can be programmed to permit 100% overlap of a selected number of sheets on either or both staging surfaces 24A and 24B. As a result, stager apparatus 10 can not only perform the combined functions of staging and turning, but also the function of accumulating.

FIGS. 7–13 illustrate some examples of how stager apparatus 10 allows flexibility in the control of sheets as sheets exit the staging area and merger location 34. Ejection of each sheet from each staging surface 24A and 24B is independently controlled by the electronic controller. This flexibility in control allows all material accumulation modes required by downstream devices to be supported. Such material accumulation modes can be dictated by the way the material is programmed (i.e., A to Z versus Z to A, and horizontal programming versus vertical programming) or the ways the individual sheets within the same set (e.g., a four-page document) are accumulated (i.e., over-accumulating versus under-accumulating). As regards horizontal programming, the modes supported include both inside-first and outside-first modes.

Figure 7:
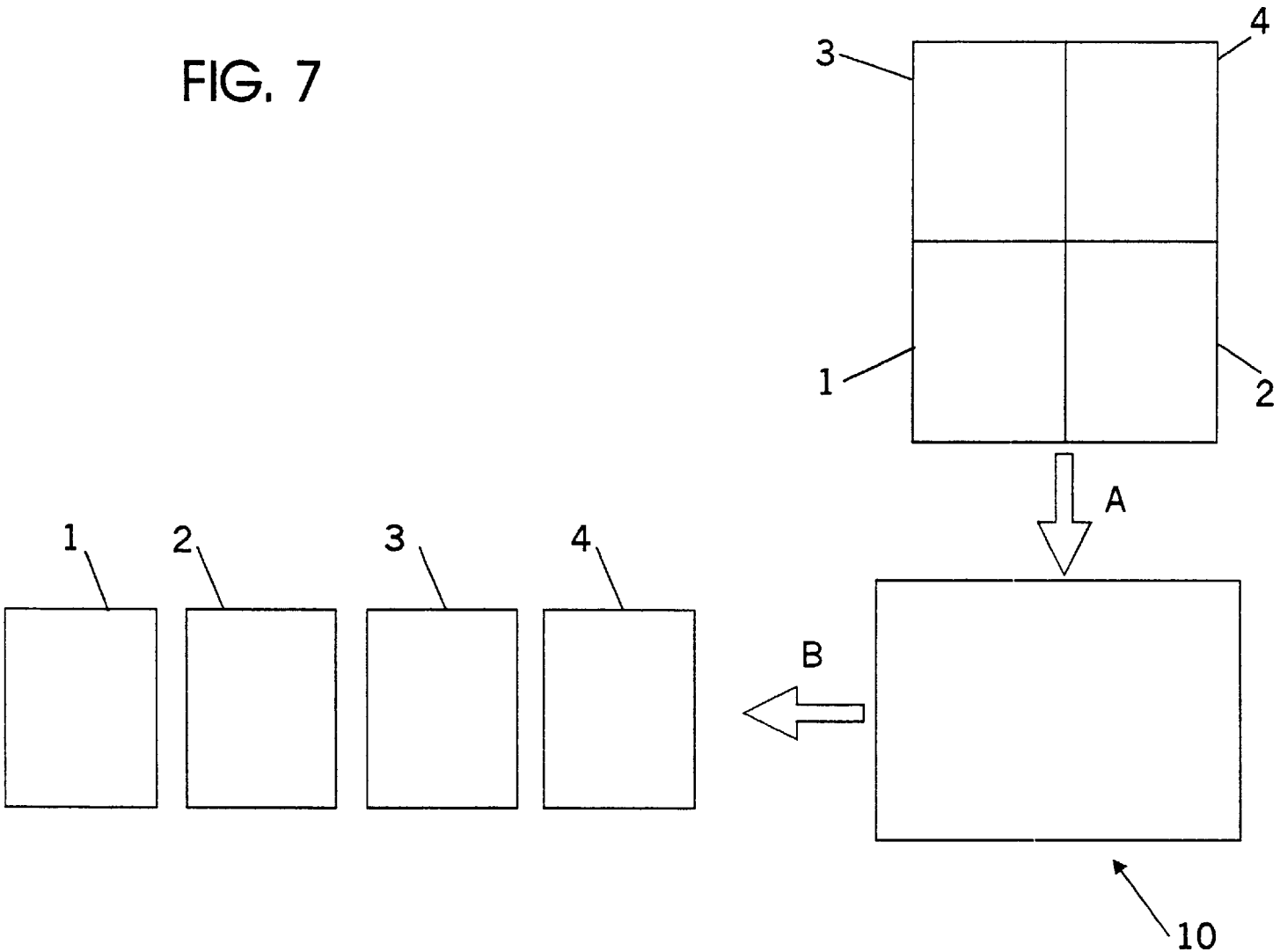
FIGS. 7–13 are schematic diagrams illustrating examples of how sheet streams can be processed in accordance with the present invention.

FIG. 7 illustrates a control method characterized by A to Z ordering, inside-first programming, and exit gapping. In FIG. 7, sheets 1, 2, 3 and 4 are initially provided on a length of two-up material and can be part of a 4-page document (i.e., page 1 of 4, page 2 of 4, page 3 of 4, and page 4 of 4) to be processed as a single document and mailed out in a single envelope. Sheet 1 enters inside input channel 20A towards the staging area in the direction generally indicated by arrow A, and sheet 2 enters outside input channel 20B in the same direction adjacent to inside input channel 20A. Sheet 3 subsequently follows sheet 1 as part of the same sheet stream, and sheet 4 likewise follows sheet 2 adjacent to sheet 3. Sheets 1–4 are then conveyed towards output channel 30 in the direction generally indicated by arrow B. If desired, sheets 1–4 can be respectively staged in the staging area for predetermined time periods prior to being conveyed towards output channel 30.

It can be seen that if sheets 1–4 enter stager apparatus in a portrait orientation, stager apparatus 10 can turn the respective sheet streams 90 degrees without physically turning sheets 1–4 themselves. As a result, sheets 1–4 can be merged into a single output stream in a predetermined order and in a landscape orientation. Alternatively, it will be understood that stager apparatus 10 can be configured to receive an input of one or more sheet streams in which sheets are initially in the landscape orientation, such that the sheets will be turned, merged, and then outputted in the portrait orientation.

In the example illustrated by FIG. 7, sheet 1 leads sheet 2 and sheet 3 leads sheet 4 in the output stream (hence, inside-first programming is implemented). Moreover, stager apparatus 10 is programmed to process each sheet 1–4 with 0% overlap and accordingly to dump each sheet 1–4 separately. This control method is thus further characterized by exit gapping.

In order to increase the rate at which stager apparatus 10 processes sheet material, stager apparatus 10 can be programmed to implement exit overlapping in a variety of ways, as illustrated below with reference to FIGS. 8–13.

Figure 8:
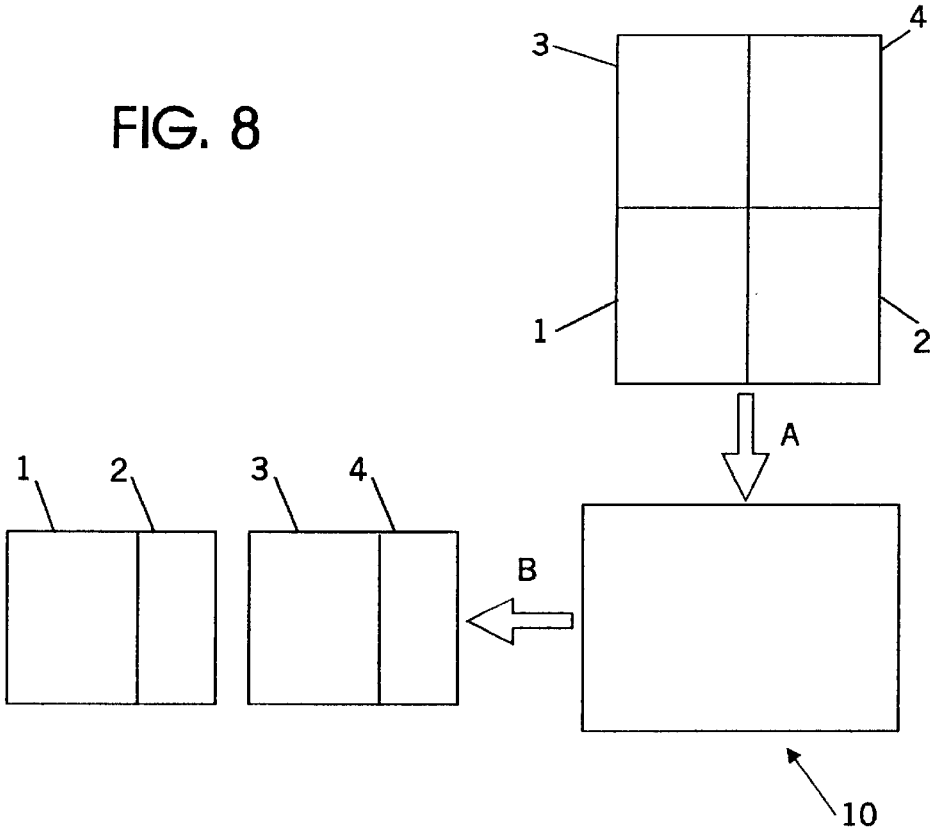

FIG. 8 illustrates a control method characterized by A to Z ordering, inside-first programming, and exit overlapping with under-accumulation. At merger location 34, sheet 1 is permitted to overlap onto sheet 2 and sheet 3 is subsequently permitted to overlap onto sheet 4, such that sheet 2 accumulates under sheet 1 and sheet 4 accumulates under sheet 3. Still, sheet 1 leads sheet 2 and sheet 3 leads sheet 4 in the output stream.

Figure 9:
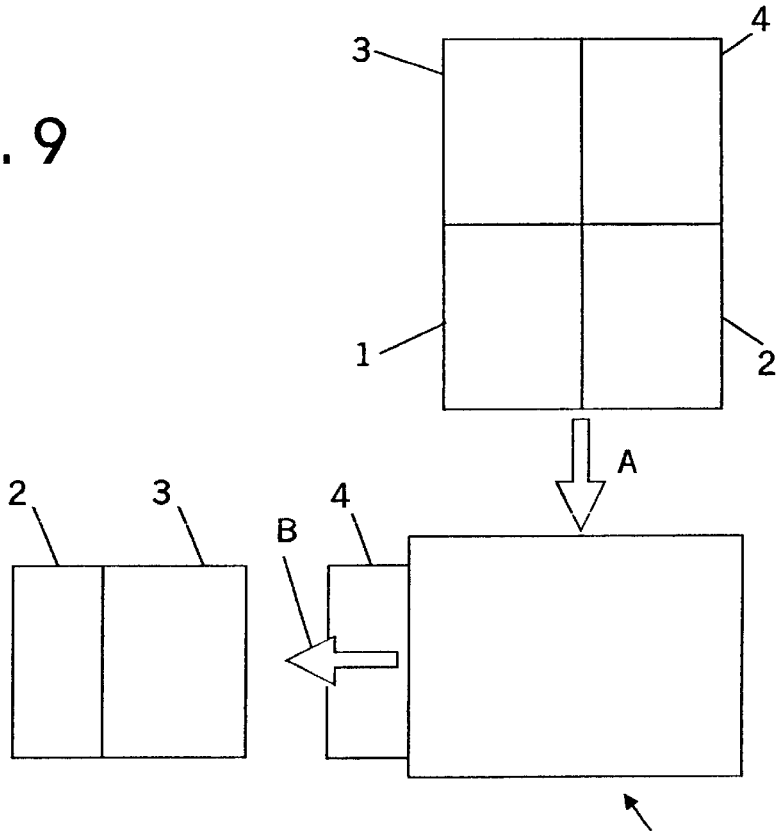

FIG. 9 illustrates a control method characterized by A to Z ordering, inside-first programming, and exit overlapping with over-accumulation. At merger location 34, sheet 3 is permitted to overlap onto sheet 2.

Figure 10:
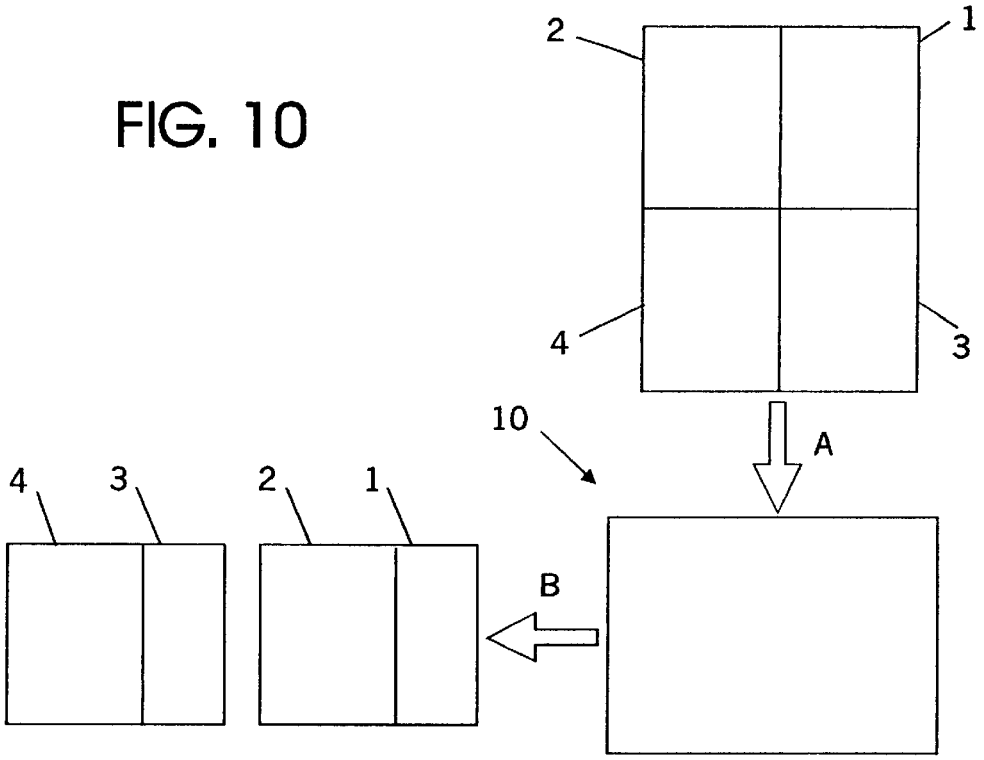

FIG. 10 illustrates a control method characterized by Z to A ordering, inside-first programming, and exit overlapping with under-accumulation. Sheet 4 is permitted to overlap onto sheet 3 and sheet 2 is subsequently permitted to overlap onto sheet 1, such that sheet 3 accumulates under sheet 4 and sheet 1 accumulates under sheet 2. Sheet 4 leads sheet 3 and sheet 2 leads sheet 1 in the output stream.

Figure 11:
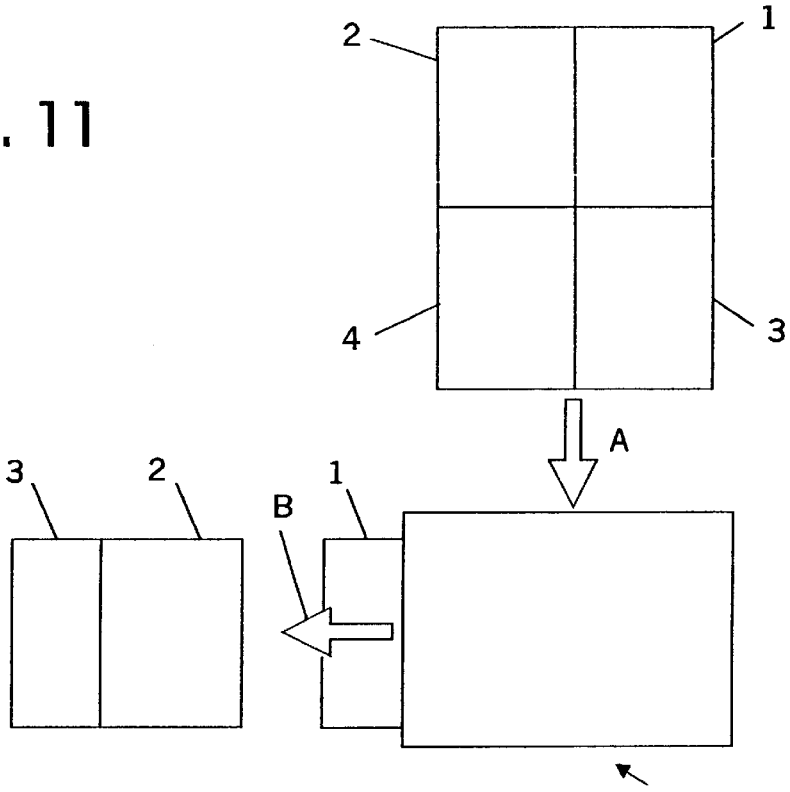

FIG. 11 illustrates a control method characterized by Z to A ordering, inside-first programming, and exit overlapping with over-accumulation. At merger location 34, sheet 2 is permitted to overlap onto sheet 3.

Figure 12:
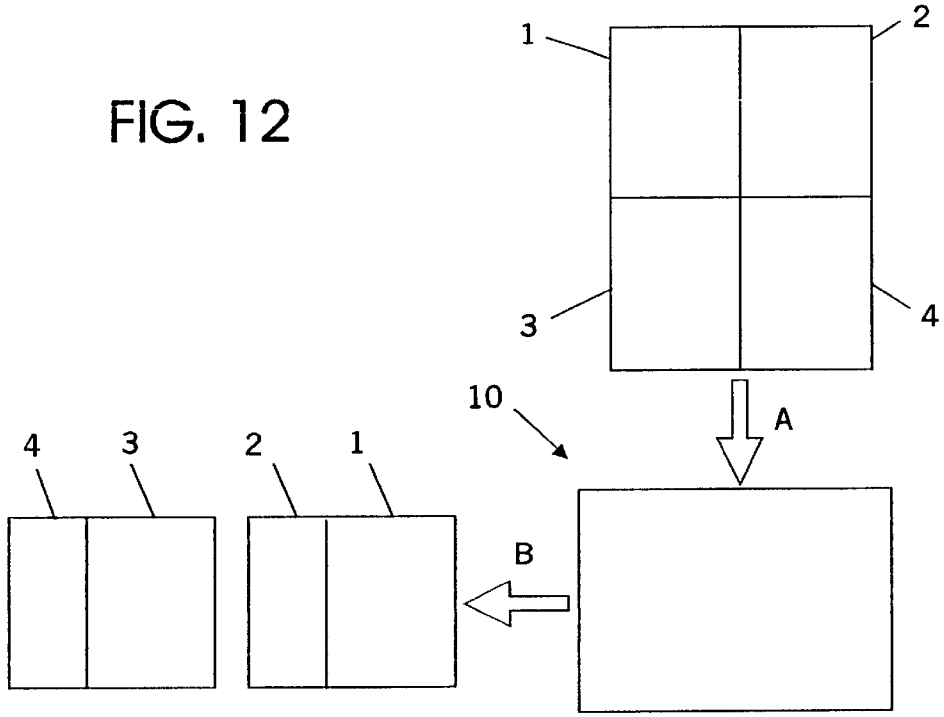

FIG. 12 illustrates a control method characterized by Z to A ordering, outside-first programming, and exit overlapping with over-accumulation. Sheet 4 leads sheet 3 and sheet 2 leads sheet 1 in the output stream. At merger location 34, sheet 3 is permitted to overlap onto sheet 4 and sheet 1 is permitted to overlap onto sheet 2.

Figure 13:
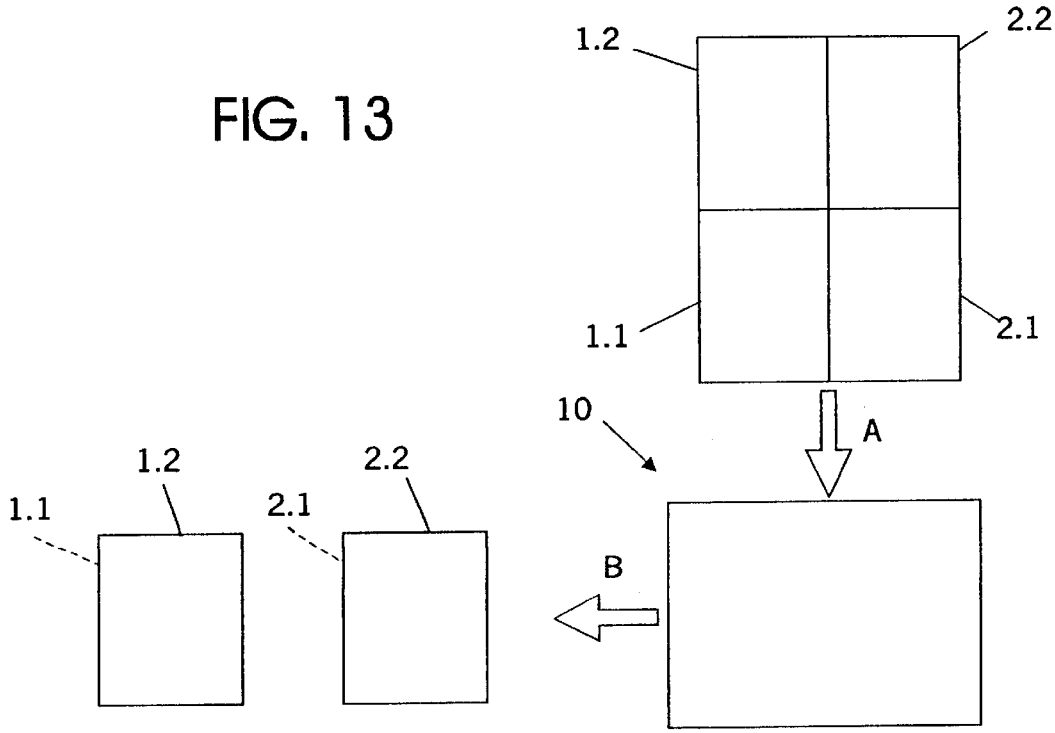

FIG. 13 illustrates a control method characterized by A to Z ordering, vertical programming, and 100% stager overlapping with over-accumulation. In this example, inside input channel 20A and outside input channel 20B process entirely independent sets of sheets. For example, sheets 1.1 and 1.2 could comprise a first document to be mailed to a first recipient while sheets 2.1 and 2.2 could comprise a different, second document to be mailed to a second recipient. Sheets 1.1 and 1.2 exit merger location 34 first, with sheet 1.2 100% overlapped with sheet 1.1. Subsequently, sheet 2.2 is 100% overlapped with sheet 2.1.

It will be understood that stager apparatus 10 can be programmed to cause both stage overlapping and exit overlapping in order to further increase the rate at which stager apparatus 10 processes sheet material.

It will also be understood that the present invention is not limited to the processing of two-up material as described by way of example hereinabove. On the contrary, the present invention is equally applicable to operations involving more than two input paths and their associated sheet streams, as well as a single input path and sheet stream. Such other applications fall within the scope of the present invention and accompanying claims.

It will be further understood that various details of the invention may be changed without departing from the scope of the invention. Furthermore, the foregoing description is for the purpose of illustration only, and not for the purpose of limitation—the invention being defined by the claims.

What is claimed:

1. A right-angle sheet stager apparatus for merging multiple input sheet streams into a single output sheet stream, the apparatus comprising:

(a) a plurality of input channels, each input channel including a transport surface, a staging surface and a transitional member interposed between the transport surface and the staging surface, each staging surface disposed downstream of its corresponding transport surface, wherein one of the transitional members includes an upper surface disposed at an elevation greater than an elevation of its corresponding staging surface; and (b) an output channel including an output surface, the output channel oriented in a right-angle relation with respect to the input channels and communicating with the input channels at a merger location.

2. The apparatus according to claim 1 wherein one of the transport surfaces is disposed at an elevation greater than the elevation of its corresponding staging surface.

3. The apparatus according to claim 1 wherein an upper surface of one of the transitional members is greater than an elevation of its corresponding transport surface.

4. A right-angle sheet stager apparatus for merging multiple input sheet streams into a single output sheet stream, the sheet stager apparatus comprising:

(a) an inside input path including an inside transport surface and an inside staging surface, the inside staging surface having an elevation and communicating with the inside transport surface at an inside interface location, the inside interface location including an upper surface having an elevation greater than the elevation of the inside staging surface;

(b) an outside input path including an outside transport surface and an outside staging surface communicating with the outside transport surface at an outside interface location, the outside staging surface having an elevation different from the elevation of the inside staging surface, the outside interface location including an upper surface having an elevation greater than the elevation of the outside staging surface; and (c) an output path including an output surface, the output path oriented in a right-angle relation with respect to the inside and outside input paths and communicating with the inside and outside input paths at a merger location.

5. The apparatus according to claim 4 wherein the inside transport surface has an elevation greater than the elevation of the inside staging surface and the outside transport surface has an elevation greater than the elevation of the outside staging surface.

6. The apparatus according to claim 4 wherein the elevation of the upper surface of the inside interface location is greater than an elevation of the inside transport surface and the elevation of the upper surface of the outside interface location is greater than an elevation of the outside transport surface.

7. A right-angle sheet stager apparatus for merging multiple input sheet streams into a single output sheet stream comprising:

(a) a plurality of means for transporting a plurality of sheet streams along a plurality of different respective input paths;

(b) a plurality of means for staging sheets of the respective sheet streams, each staging means communicating with a corresponding one of the transporting means at a transitional location disposed between each staging means and corresponding transporting means, wherein the sheets are staged in each staging means at an elevation different than an elevation of the other staging means; and (c) means for directing sheets received and staged at the plurality of staging means into a single output sheet stream along an output path, wherein the output path is substantially perpendicular to each of the plurality of input paths.

8. The apparatus according to claim 7 wherein the sheets received by each staging means are staged in the staging means at an elevation lower than an elevation of the corresponding transitional location.

9. A right-angle sheet stager apparatus for merging multiple input sheet streams into a single output sheet stream, the right angle sheet stager apparatus comprising:

(a) a plurality of input channels, each input channel including an input surface and terminating at a staging surface;

(b) an output channel including an output surface, the output channel oriented in a substantially right-angle relation with respect to the input channels and communicating with the input channels at a merger location; and (c) means for driving a first sheet staged on one of the staging surfaces toward the output channel after a second sheet being fed into the staging surface from its corresponding input surface has moved into an overlapping relation with the first sheet.

10. A right-angle sheet stager apparatus for merging multiple input sheet streams into a single output sheet stream, the right angle sheet stager apparatus comprising:

(a) a plurality of input channels, each input channel including an input surface and terminating at a staging surface;

(b) an output channel including an output surface, the output channel oriented in a substantially right-angle relation with respect to the input channels and communicating with the input channels at a merger location; and (c) means for driving a first sheet received at the merger location from a first one of the staging surfaces along the output surface after a second sheet received from a second one of the staging surfaces has moved into an overlapping relation with the first sheet.

11. A right-angle sheet stager apparatus comprising:

(a) an input channel including a transport surface and a staging surface, the transport surface communicating with the staging surface at a transitional member interposed between the transport surface and the staging surface, the transitional member having an upper surface disposed at an elevation greater than an elevation of the staging surface; and (b) an output channel oriented in a substantially right-angle relation with respect to the input channel.

12. A method for merging multiple input sheet streams into a single output sheet stream oriented at a right angle with respect to the input sheet streams comprising the steps of:

(a) providing a staging area including a plurality of staging surfaces disposed at different elevations;

(b) feeding a plurality of sheets in a plurality of input sheet streams into the staging area, wherein the sheets of each input sheet stream are transported onto a corresponding one of the staging surfaces;

(c) providing a sheet outfeed area including an output surface in communication with each of the staging surfaces;

(d) staging a first sheet on a first one of the staging surfaces;

(e) bringing the first sheet into contact with a sheet driving mechanism;

(f) activating the sheet driving mechanism to transport the first sheet towards the outfeed area; and (g) permitting a second sheet to enter the first staging surface and to overlap with the first sheet prior to transportation of the entire first sheet out of the staging area.

13. The method according to claim 12 comprising the step of permitting a plurality of sheets to enter the first staging surface and accumulate thereon prior to transportation of the first sheet out of the staging area.

14. The method according to claim 12 comprising the steps of staging a third sheet on a second one of the staging surfaces, causing the first sheet and the third sheet to merge into a single output sheet stream at a merger location disposed downstream of the staging area, and permitting the first and third sheets to enter into an overlapping relation at the merger location.

15. The method according to claim 12 comprising the steps of causing the first sheet and the second sheet to merge into a single output sheet stream at a merger location disposed downstream of the staging area, and permitting the first and second sheets to enter into an overlapping relation at the merger location.

16. A method for merging multiple input sheet streams into a single output sheet stream oriented at a right angle with respect to the input sheet streams comprising the steps of:

(a) providing a staging area including a plurality of staging surfaces disposed at different elevations, wherein each staging surface includes a sheet driving element operatively associated therewith;

(b) feeding a plurality of sheets in a plurality of input sheet streams into the staging area, wherein the sheets of each input sheet stream are transported onto a corresponding one of the staging surfaces;

(c) providing a sheet outfeed area including an output surface in communication with each of the staging surfaces;

(d) staging a first sheet on a first one of the staging surfaces;

(e) staging a second sheet on a second one of the staging surfaces;

(f) bringing the first sheet into contact with the sheet driving element of the first staging surface;

(g) bringing the second sheet into contact with the sheet driving element of the second staging surface;

(h) activating the sheet driving element of the first staging surface to transport the first sheet towards the outfeed area in a direction substantially perpendicular to at least one of the input sheet streams; and (i) activating the sheet driving element of the second staging surface to transport the second sheet towards the outfeed area in a direction substantially perpendicular to at least one of the input sheet streams.

17. The method according to claim 16 comprising the step of causing a subsequent sheet to enter the first staging surface and to overlap with the first sheet prior to transportation of the first sheet out of the staging surface.

18. The method according to claim 16 comprising the step of permitting a plurality of sheets to enter the first staging surface and accumulate thereon prior to transportation of the first sheet out of the staging area.

19. The method according to claim 16 comprising the step of merging the first and second sheets into a single output sheet stream at a merger location.

20. The method according to claim 19 comprising the step of permitting the first and second sheets to overlap at the merger location.

21. The method according to claim 20 comprising the steps of transporting a third sheet from the first staging surface towards the outfeed area, transporting a fourth sheet from the second staging surface towards the outfeed area, merging the third and fourth sheets at the merger location, and permitting the third and fourth sheets to overlap at the merger location.

22. The method according to claim 16 comprising the steps of transporting a third sheet from the first staging surface towards the outfeed area, merging the second and third sheets at the merger location, and permitting the second and third sheets to overlap at the merger location.

23. The method according to claim 16 comprising the steps of transporting a third sheet from the first staging surface towards the outfeed area, transporting a fourth sheet from the second staging surface towards the outfeed area, merging the third and fourth sheets at the merger location, and permitting the third and fourth sheets to overlap at the merger location.

24. The method according to claim 16 comprising the steps of transporting a third sheet from the first staging surface towards the outfeed area, merging the first and third sheets at the merger location, and permitting the first and third sheets to overlap at the merger location.

25. The method according to claim 24 comprising the steps of transporting a fourth sheet from the second staging surface towards the outfeed area, merging the second and fourth sheets at the merger location, and permitting the second and fourth sheets to overlap at the merger location.

* * * * *